US008955812B2

(12) United States Patent
Marrow

(10) Patent No.: US 8,955,812 B2
(45) Date of Patent: Feb. 17, 2015

(54) COMPOSITE SHIPPING BASE WITH INTERLOCKING DETACHABLE SUB-STRUCTURE

(71) Applicant: Sonoco Development, Inc., Hartsville, SC (US)

(72) Inventor: Matthew Marrow, Hendersonville, TN (US)

(73) Assignee: Sonoco Development, Inc., Hartsville, SC (US)

( * ) Notice: Subject to any disclaimer, the term of this patent is extended or adjusted under 35 U.S.C. 154(b) by 134 days.

(21) Appl. No.: 13/705,773

(22) Filed: Dec. 5, 2012

(65) Prior Publication Data

US 2014/0151521 A1 Jun. 5, 2014

(51) Int. Cl.

*A47B 91/00* (2006.01)
*B65D 19/00* (2006.01)
*D06F 39/00* (2006.01)

(52) U.S. Cl.

CPC ..... *B65D 19/0002* (2013.01); *D06F 39/001* (2013.01)
USPC ..... 248/346.03; 248/346.02; 248/678; 312/351.1; 312/228; 206/320; 108/51.3

(58) Field of Classification Search

CPC .... B65D 85/66; B65D 81/133; B65D 19/002; B65D 19/44; D06F 39/001; D06F 39/125; A47B 91/005
USPC ..... 248/346.03, 346.02, 346.01, 688, 678, 248/346.5; 108/51.11, 53.1, 53.3, 91; 312/228, 351.1; 206/591, 592, 493, 206/408, 586, 355, 320, 486, 488, 490, 489, 206/764, 45.27
See application file for complete search history.

(56) References Cited

U.S. PATENT DOCUMENTS

| | | | | |
|---|---|---|---|---|
| 3,504,842 | A * | 4/1970 | Grafslund | 206/320 |
| 5,016,853 | A | 5/1991 | Cox | |
| 5,056,341 | A * | 10/1991 | Mori et al. | 68/3 R |
| 5,083,845 | A | 1/1992 | Sparks et al. | |
| 5,092,464 | A * | 3/1992 | Taylor et al. | 206/408 |
| 5,911,179 | A * | 6/1999 | Spiczka | 108/51.11 |
| 5,934,107 | A * | 8/1999 | Lee et al. | 68/3 R |
| 6,298,989 | B1 | 10/2001 | Chu | |
| 7,014,160 | B2 * | 3/2006 | Muyskens | 248/346.03 |
| 7,624,962 | B2 * | 12/2009 | Muyskens | 248/678 |
| 8,505,719 | B2 * | 8/2013 | Rodriguez Sanchez et al. | 206/320 |
| 2008/0173781 | A1 * | 7/2008 | Muyskens | 248/346.01 |
| 2011/0132239 | A1 * | 6/2011 | Poulsen et al. | 108/55.1 |

FOREIGN PATENT DOCUMENTS

| | | | |
|---|---|---|---|
| CN | 102094306 | A | 6/2011 |
| JP | 53133192 | A * | 11/1978 |

(Continued)

*Primary Examiner* — Kimberly Wood
(74) *Attorney, Agent, or Firm* — Miller, Matthias & Hull LLP

(57) ABSTRACT

A composite shipping base for supporting an appliance such as a washing machine is provided having a detachable sub-structure that can be added during the washing machine assembly to restrict the vertical and lateral movement of a centralized load of the washing machine during assembly, shipping and handling. A rigid bottom frame allows for the composite shipping base and appliance to move down virtually any form of conveyance and to be lifted or turned during the course of conveyance.

11 Claims, 4 Drawing Sheets

(56) References Cited

FOREIGN PATENT DOCUMENTS

| | | | |
|---|---|---|---|
| JP | 03133768 A | * | 6/1991 |
| JP | 03187868 A | * | 8/1991 |
| JP | 06048478 A | * | 2/1994 |
| JP | 06048479 A | * | 2/1994 |
| JP | 06156572 A | * | 6/1994 |
| JP | 06156573 A | * | 6/1994 |

* cited by examiner

COMPOSITE SHIPPING BASE WITH INTERLOCKING DETACHABLE SUB-STRUCTURE

BACKGROUND OF THE INVENTION

1. Field of the Invention

This invention relates to protective packaging for large appliances. More particularly, this invention solves the problem of providing support for the centralized load of an appliance during and after assembly.

2. Description of the Related Art

Top-loading washing machines generally comprise a spin or wash tub located within a washing machine cabinet or housing. The tub itself is suspended from the cabinet by suspension rods. Some washing machines have a center pivoting agitator extending upwardly from the bottom of the wash tub and operably connected to a motor located below the tub. Other washing machines lack this center agitator and instead have ridges located on the inside of the wash tub to assist with the agitating function. In washing machines without the center agitator, an agitator motor typically is suspended from the underside of the wash tub so that the tub itself may oscillate up and down and/or rotate back and forth to agitate and clean the clothes. In either type of washing machine, and in other large appliances, the motor and/or other components that are suspended from or located under the wash tub may be referred to as the "centralized load."

Washing machines and other large household appliances typically are assembled while being carried on a base. At some point in the assembly process the centralized load is installed from underneath the cabinet, typically by lifting up or tilting the cabinet. Then the appliance is placed back on the base and assembly continues. The base may remain with the appliance after assembly and during shipping.

In such appliance assemblies a detachable sub-structure is needed which can be added to the base after the centralized load is installed to support the centralized load. The base, and thus the detachable sub-structure, may stay with the assembled appliance during shipping.

It is an object of the present invention to fulfill the need described above.

Further and additional objects will appear from the description, accompanying drawings, and appended claims.

SUMMARY OF THE INVENTION

The present disclosure related to a composite shipping base for an appliance. In one aspect of the disclosure the shipping base comprises a rigid bottom frame, a bottom panel and a center insert. The rigid bottom frame comprises opposing side members forming a rigid support structure and a cross member extending between two opposing side members. The bottom panel is affixed to the bottom frame, has a top surface, and defines a center opening. The center insert may be detachably secured within the center opening so that it extends upwardly from the top surface. The center opening may be in vertical alignment with at least a portion of the cross member.

In a refinement of the invention the bottom panel has four corners and the shipping base further comprises a corner support affixed to the top surface of the bottom panel near each of the four corners. Each corner support defines a hole for receiving an appliance foot.

In another refinement of the invention the shipping base further comprises means for preventing the center insert from rotating with respect to the bottom panel. For example, the center insert may comprise a body having a non-circular horizontal cross-sectional area at its base that registers within a like shaped center opening to prevent the center insert from rotating with respect to the bottom frame.

Alternatively, the center insert may comprise a substantially cylindrical body having a circular horizontal cross-sectional profile and at least one boss member extending laterally from a lower portion of the body that registers with the center opening to prevent the center insert from rotating with respect to the bottom frame. More particularly, the center opening may include at least one locating cutout that renders the center opening non-circular and the boss member registers with the at least one locating cutout.

In another refinement the center insert has a body having a top surface and a bottom surface, and the body defines a diametrically extending slot located in the bottom surface and configured to receive the cross member. The top surface may be configured to abut a centralized load located within the appliance.

The bottom frame is made of a first material such as wood. The bottom panel may be made of a second material that is less rigid than the first material, such as corrugated board. The center insert may be made of a third material that is different from the first material and the second material, such as a plastic foam material.

In another aspect of the invention an appliance and shipping base assembly is provided. The assembly comprises an appliance having a tub, a frame surrounding the tub and having a bottom surface, and a centralized load suspended underneath the tub. The composite shipping base comprises a primary structure and a detachable sub-structure. The primary structure comprises a bottom panel having a top surface. The sub-structure comprises a center insert that is detachably affixed to the primary structure. The composite shipping base is disposed under the appliance so that the appliance frame rests on the primary structure and the center insert supports the centralized load.

In a refinement of the invention the primary structure further comprises a rigid bottom frame affixed to the bottom panel and having opposing side members and a cross member extending between two opposing side members. The bottom panel defines a center opening. The center insert is secured within the center opening and extends upwardly from the bottom panel to support the centralized load.

In a further refinement the primary structure further comprises corner supports affixed to a top surface of the bottom panel, and the appliance rests on the corner supports. The appliance may further comprise feet extending below the bottom surface and into holes located in the corner supports.

In another aspect of the invention a method of assembling an appliance and base assembly of the type disclosed herein is provided. The method comprises the steps of: A method of assembling an appliance and base assembly, the method comprising the steps of: (a) providing a partially assembled composite shipping base comprising a bottom panel and a rigid frame affixed to an underside of the bottom panel, the bottom panel having a top surface defining a center opening, the rigid frame having opposing side members and a cross member extending between two opposing side members, wherein the center opening and a portion of the cross member are in vertical alignment; (b) providing a partially assembled appliance having a frame and a bottom surface; (c) locating the partially assembled appliance onto the partially assembled composite shipping base; (d) lifting up or tilting the partially assembled appliance; (e) installing a centralized load while the partially assembled appliance is lifted up or tilted; (f) inserting a portion of the center insert into the center opening after the centralized load is installed so that the center insert cannot move laterally to provide a fully assembled composite shipping base; and (g) re-positioning the partially assembled appliance back down onto the fully assembled composite shipping base so that so that the center insert is supporting the centralized load and preventing the centralized load from moving vertically.

In a refinement of the assembly method step (f) further comprises inserting a portion of the center insert into the center opening so that a slot located on a bottom surface of the center insert mates with a portion of the cross member.

In another refinement of the assembly method step (f) further comprises inserting a portion of the center insert into the center opening so that at least one boss member extending laterally from the center insert mates with a locating cutout defined by the bottom panel, thereby preventing rotational movement of the center insert with respect to the bottom panel.

In another refinement of the assembly method step (a) further comprises providing a partially assembled composite shipping base having corner supports affixed to the bottom panel, each corner support defining a hole; step (b) further comprises and providing a partially assembled appliance having feet extending from the frame and below the bottom surface; and step (e) further comprises inserting the appliance feet into the holes so that the bottom surface rests on the corner supports.

THE DRAWINGS

DETAILED DESCRIPTION OF THE INVENTION

Figure 1:
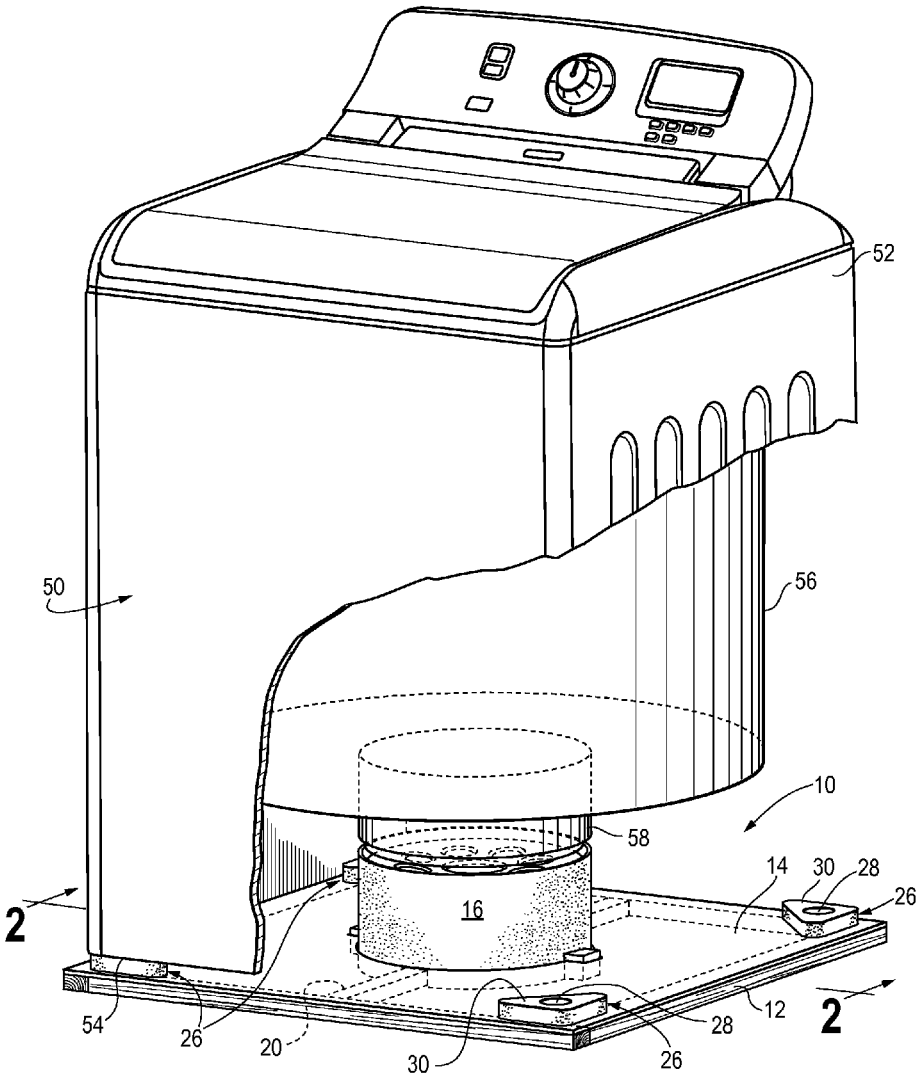
FIG. 1 is a cutaway perspective view of a composite shipping base according to an aspect of the invention shown supporting an appliance.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

Top-loading washing machines generally comprise a spin or wash tub located within a washing machine cabinet or housing. Some washing machines have a center pivoting agitator extending upwardly from the bottom of the wash tub and operably connected to a motor located below the tub. Other washing machines lack this center agitator and instead have ridges located on the inside of the wash tub to assist with the agitating function. In washing machines without the center agitator, an agitator motor typically is suspended from the underside of the wash tub so that the tub itself may oscillate up and down and/or rotate back and forth to agitate and clean the clothes. In either type of washing machine and in other large appliances the motor and other components may be referred to as the "centralized load."

During the appliance assembly process the centralized load and other components typically are added while the appliance cabinet travels along an assembly line. The appliance cabinet typically is supported by a base that remains with the appliance both during and after assembly. At some point in the assembly process the centralized load is installed from underneath the cabinet, typically by lifting up or tilting the cabinet.

The present invention is a composite shipping base having a detachable sub-structure or support component which can be added to the base during the appliance assembly process after the centralized load is installed. The base, and thus the detachable sub-structure, may stay with the assembled appliance during shipping.

Composite Shipping Base

Turning to the drawings, there is shown in FIG. 1 a cutaway perspective view of a composite shipping base 10 shown supporting an appliance 50. The appliance 50 may be a top loading washing machine of the type having a rigid frame 53 disposed within a cabinet 52 and having a bottom surface 54, a wash tub 56 located within the cabinet 52, a centralized load 58 suspended underneath the wash tub 56 and operably connected to an agitator (not shown) located within the wash tub 56, and four feet 59 (FIG. 2) extending below the bottom surface 54 of the frame 53. The composite shipping base 10 comprises corner supports 26 located at each corner of the base 10.

Figure 2:
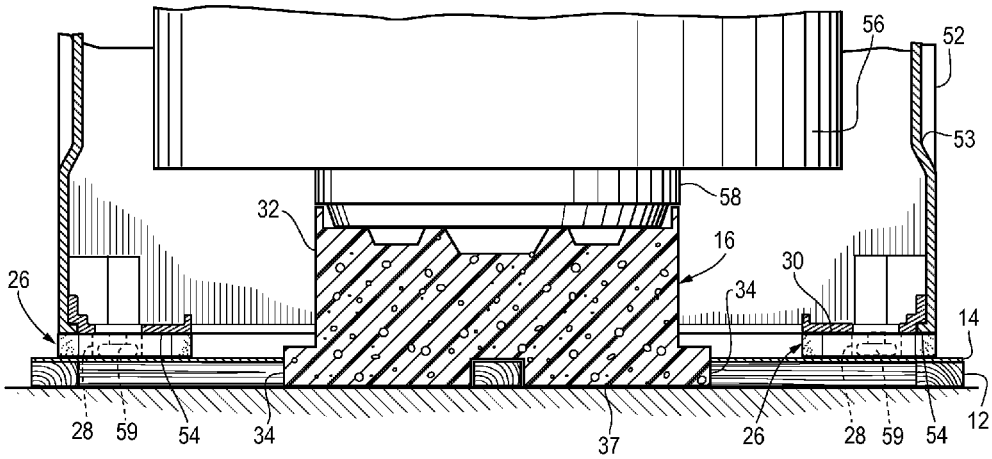
FIG. 2 is a cross-sectional view of the composite shipping base and appliance of FIG. 1 taken along line 2-2.

FIG. 2 is a cross-sectional view of the composite shipping base 10 and appliance 50 of FIG. 1 taken along line 2-2. Each corner support 26 defines a hole 28 for receiving an appliance foot 59. In this way the appliance feet 59 can extend into the holes 28 and the appliance cabinet 52 can rest directly on the top, load bearing surfaces 30 of the corner supports 26.

Figure 3:
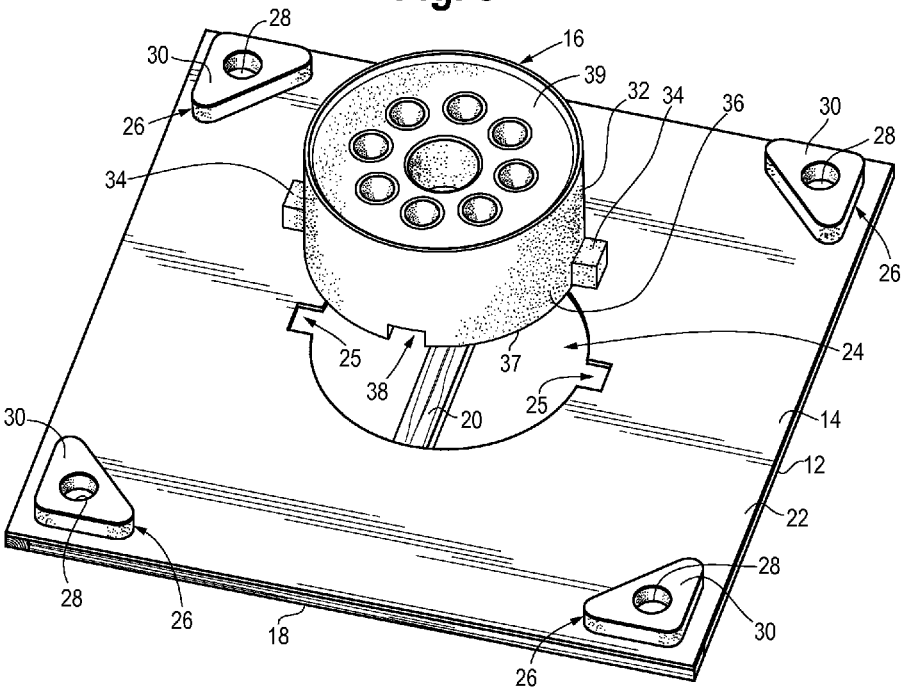
FIG. 3 is an exploded perspective view of a composite shipping base according to an aspect of the invention.

FIG. 3 is an exploded perspective view of a composite shipping base 10 according to an aspect of the invention. The composite shipping base 10 comprises a primary structure on which the appliance 50 is placed at the beginning of assembly and a detachable interlocking sub-structure that is added to the composite shipping base 10 after the centralized load is added to the appliance 50. The primary structure comprises a rigid bottom frame 12 and a bottom panel 14. The sub-structure comprises a center insert 16.

Figure 4:
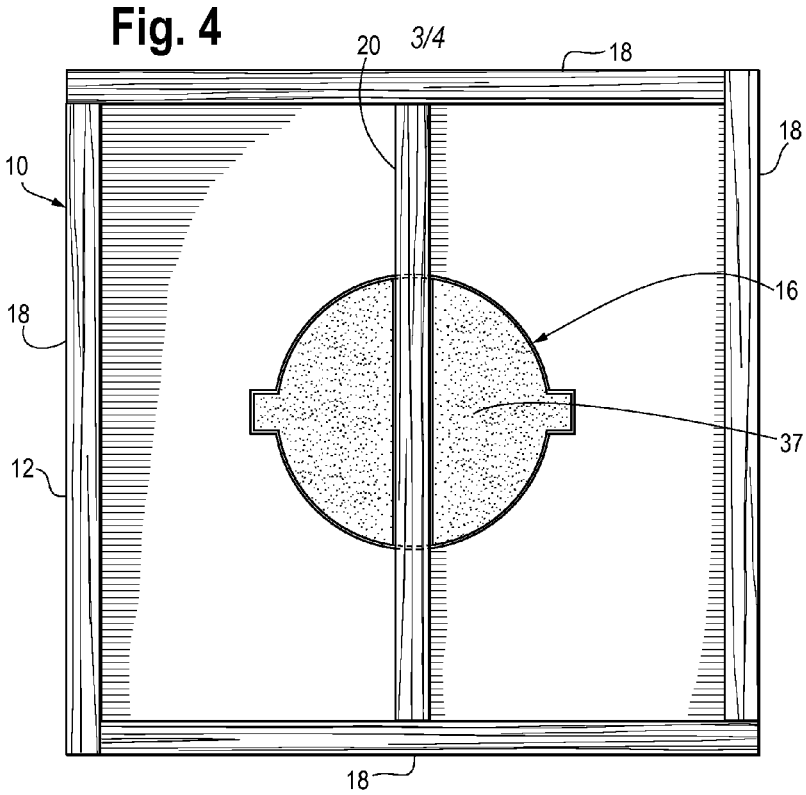
FIG. 4 is a bottom view of a composite shipping base according to an aspect of the invention.

FIG. 4 is a bottom view of a composite shipping base 10. The bottom frame 12 comprises opposing side members 18 and a cross member 20 extending between two opposing side members 18 which form a rigid support structure.

The bottom panel 14 is affixed to the bottom frame 12 and has a top surface 22 (FIG. 1). The bottom panel 14 may be rectangular and may have four corners. The bottom panel 14 defines a center opening 24 for receiving the center insert 16. The center opening 24 is in vertical alignment with at least a portion of the cross member 20. The center opening 24 may be substantially circular or any suitable shape, and may include at least one locating cutout 25 for receiving a boss member 34 as explained below, the locating cutout 25 rendering the center opening non-circular.

Figure 5:
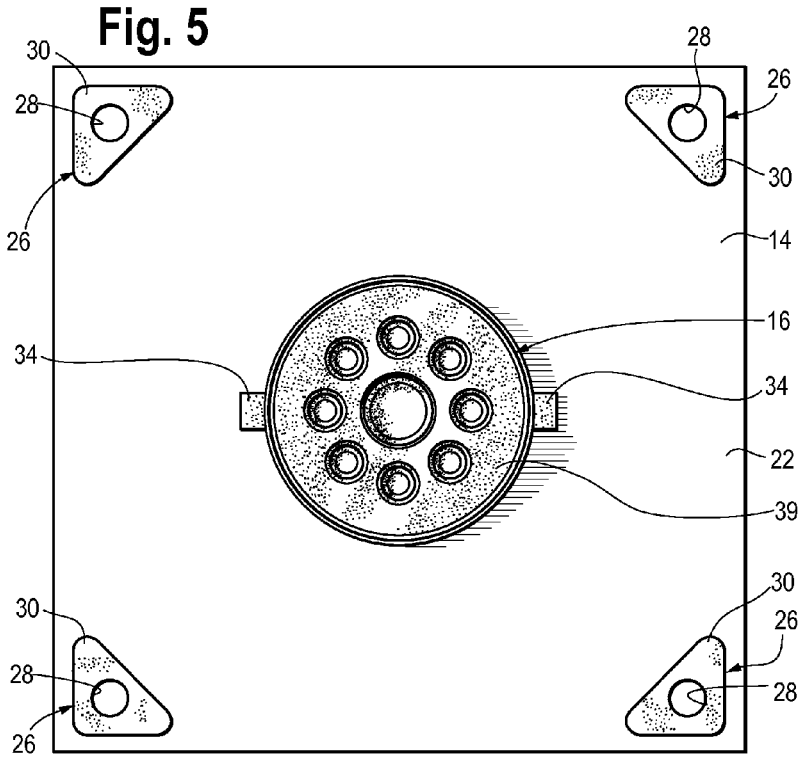
FIG. 5 is a top view of a composite shipping base according to an aspect of the invention.
Figure 6:
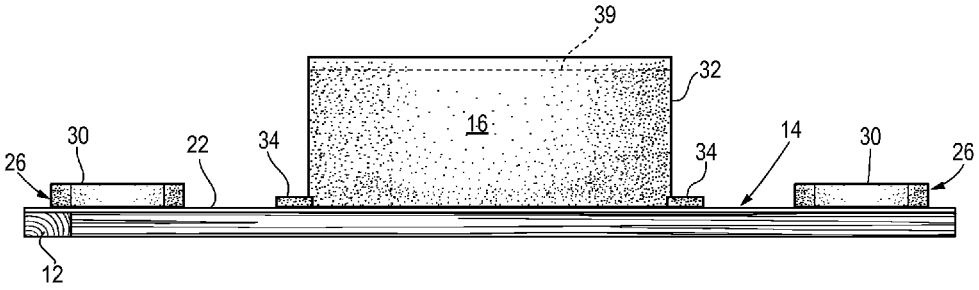
FIG. 6 is a side view of the composite shipping base of FIG. 5.

FIG. 5 is a top view and FIG. 6 is a side view of the composite shipping base 10. The center insert 16 is detachably secured within the center opening 24 and extends upwardly from the top surface 22 of the bottom panel 14. The composite shipping base 10 may further comprise a corner support 26 affixed to the top surface 22 of the bottom panel 14 near each of the four corners. Each corner support 26 may define a hole 28 for receiving an appliance foot. In this way the appliance feet can extend into the holes 28 and the appliance cabinet 52 (FIG. 2) can rest directly on the top, load bearing surfaces 30 of the corner supports.

The composite shipping base 10 further comprises means for preventing the center insert 16 from rotating with respect to the primary bottom panel 14. Thus, in one aspect of the invention, the center insert comprises a body having a non-circular (for example, rectangular, pentagonal or hexagonal) horizontal cross-sectional area at its base that registers within a like shaped center opening in the bottom panel to prevent the center insert from rotating with respect to the bottom panel 14.

In an alternative aspect of the invention shown in the figures, the center insert 16 comprises a substantially cylindrical body 32 having a circular horizontal cross-sectional profile and at least one boss member 34 extending laterally from a lower portion 36 of the body 32 that registers with the center opening 24 and, more particularly, with the locating cutouts 25, to prevent the center insert 16 from rotating with respect to the bottom frame 12.

Figure 7:
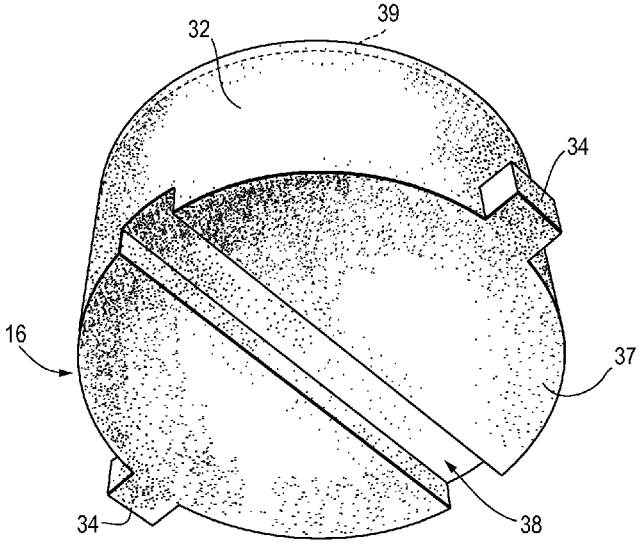
FIG. 7 is a bottom perspective view of a center insert according to an embodiment of the invention.

FIG. 7 is a bottom perspective view of a center insert 16 according to an embodiment of the invention. The body 32 of the center insert 16 defines a diametrically extending slot 38 located in the bottom surface 37 of the center insert 16. The slot 38 is configured to receive the cross member 20 when the center insert 16 is inserted into the center opening 24 in the bottom panel 14, thereby helping to prevent the center insert 16 from moving laterally. The center insert 16 has top surface 39 that abuts the centralized load.

The bottom frame 12 may be made of a first, rigid, material. The bottom panel may be made of a second material that is less rigid than the first material. The center insert may be made of a resilient third material that is different from the first material and the second material.

More particularly, the bottom frame 12 may be made of wood or any suitable rigid material. The bottom panel 14 may be made of corrugated fiberboard or any suitable rigid material. The center insert 16 and the corner supports 26 may be made of a plastic foam material such as expanded polystyrene foam (EPS).

The rigid structure of the composite shipping base 10, including the wood bottom frame 12, allows for the composite shipping base 10 and appliance 50 to move down virtually any form of conveyance, including chain, roller, ball or belt. The structure allows for the composite shipping base 10 and appliance 50 to come into contact with stops on the assembly line without damaging the base. The structure also allows for the composite shipping base 10 and appliance 50 to be lifted, or make turns and transitions during the course of conveyance.

Appliance and Base Assembly

In another aspect of the invention an appliance and shipping base assembly 60 is provided. As shown in FIG. 5, the assembly 60 may comprise an appliance 50 having a tub, a frame 53 surrounding the tub and having a bottom surface 54, a centralized load suspended underneath the tub, and four feet extending below the bottom surface 54. The assembly may further comprise a composite shipping base 10 such as that described above and comprising a bottom panel 14 having a top surface 22, wherein the composite shipping base 10 is disposed under the appliance 50 so that the appliance frame 53 rests on the corner supports 26. As noted above, the shipping base 10 further comprises a rigid bottom frame 12 having opposing side members 18 and a cross member 20 extending between two opposing side members 18. The bottom panel 14 may have four corners and may comprise a bottom surface affixed to the bottom frame 12. The bottom panel 14 defines a center opening 24. Corner supports 26 are affixed to the top surface 22 of the bottom panel 14 near each of the four corners. A center insert 16 is secured within the center opening 24 and extends upwardly from the top surface 22 of the bottom panel 14 to support the centralized load.

Method of Assembling the Appliance and Base Assembly

In another aspect of the invention a method of assembling an appliance and base assembly 60 is provided. The method comprises the steps of: (a) providing a partially assembled composite shipping base comprising a bottom panel 14 and a rigid bottom frame 12 affixed to an underside of the bottom panel 14, the bottom panel 14 having a top surface 22 defining a center opening 24, the rigid bottom frame 12 having opposing side members 18 and a cross member 20 extending between two opposing side members 18, wherein the center opening 24 and a portion of the cross member 20 are in vertical alignment; (b) providing a partially assembled appliance having a frame 53 with a bottom surface 54; (c) locating the partially assembled appliance onto the partially assembled composite shipping base; (d) lifting up or tilting the partially assembled appliance; (e) installing a centralized load 58 while the partially assembled appliance is lifted up or tilted; (f) inserting a portion of the center insert 16 into the center opening 22 after the centralized load 58 is installed so that the center insert 16 cannot move laterally to provide a fully assembled composite shipping base 10; and (g) re-positioning the partially assembled appliance 50 back down onto the fully assembled composite shipping base 10 so that so that the center insert is supporting the centralized load and preventing the centralized load from moving vertically. Assembly of the appliance 50 can then be completed.

Step (f) may further comprise inserting a portion of the center insert 16 into the center opening 24 so that a slot 38 defined by the center insert 16 and located on a bottom surface 37 of the center insert 16 mates with a portion of the cross member 20. Step (f) may also comprise inserting a portion of the center insert 16 into the center opening 24 so that at least one boss member 34 extending laterally from a lower portion 36 of the center insert 16 mates with a locating cutout 25 defined by the bottom panel 14, thereby preventing rotational movement of the center insert 16 with respect to the bottom panel 14.

Step (a) may further comprise providing a partially assembled composite shipping base having corner supports 26 affixed to the bottom panel 14, each corner support 26 defining a vertically oriented hole 28. Step (b) may further comprise providing a partially assembled appliance having feet 59 extending from the frame 53 and below the bottom surface 54. Step (e) may further comprise inserting the appliance feet 59 into the holes 28 so that the bottom surface 54 rests on the corner supports 26.

Industrial Applications

The composite shipping base 10 disclosed herein may be used to support components of a washing machine or other large household appliance, particularly the centralized load elements, during assembly, shipping and handling by restricting their movement. Preferably the detachable sub-structure (center insert 16) is added to the composite shipping base 10 only after the centralized load is added to the appliance, and extends upwardly so that it abuts or otherwise supports the centralized load. The center insert 16 cannot move laterally with respect to the composite shipping base 10, and prevents the centralized load from moving vertically by being constrained on top by the centralized load and on bottom by a cross member 20.

The composite shipping base 10 is capable of supporting the centralized load of an appliance and can travel down any means of conveyance, including a chain, ball, roller or belt conveyor. The composite shipping base can support the centralized load which may be added to the appliance at any point during conveyance.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

What is claimed is:

1. A shipping base for an appliance, the shipping base comprising:

a rigid bottom frame comprising four narrow, elongated opposing side members connected end to end to form a rigid support structure;

a bottom panel affixed to the bottom frame and having a top surface opposite the bottom frame, the bottom panel defining a center opening;

a narrow, elongated cross member extending between two opposing side members, the cross member having a width, the four opposing side members and the cross member having co-planar top surfaces on which the bottom panel can rest; and a center insert resting on the cross member and detachably secured within the center opening and extending upwardly from the top surface; wherein the center opening is in vertical alignment with at least a portion of the cross member and has a width substantially greater than the width of the cross member.

2. The shipping base of claim 1 wherein the bottom panel has four corners, the shipping base further comprising:

a corner support affixed to the top surface of the bottom panel near each of the four corners.

3. The shipping base of claim 2 wherein:

each corner support defines a hole for receiving an appliance foot.

4. The shipping base of claim 1 further comprising:

means for preventing the center insert from rotating with respect to the bottom panel.

5. The shipping base of claim 1 wherein the center insert comprises a body having a non-circular horizontal cross-sectional area at its base that registers within a similarly shaped center opening to prevent the center insert from rotating with respect to the bottom frame.

6. The shipping base of claim 1 wherein:

the center insert comprises a substantially cylindrical body having a circular horizontal cross-sectional profile and at least one boss member extending laterally from a lower portion of the body that registers with the center opening to prevent the center insert from rotating with respect to the bottom frame.

7. The shipping base of claim 6 wherein:

the center opening includes at least one locating cutout; and the center insert comprises a substantially cylindrical body having a circular horizontal cross-sectional profile and at least one boss member extending laterally from a lower portion of the body that registers with the at least one locating cutout to prevent the center insert from rotating with respect to the bottom frame.

8. The shipping base of claim 1 wherein:

the center insert has a body having a top surface and a bottom surface, the body defining a diametrically extending slot located in the bottom surface and configured to receive the cross member.

9. The shipping base of claim 1 wherein:

the top surface is configured to abut a centralized load located within the appliance.

10. The shipping base of claim 1 wherein:

the bottom frame is made of a rigid first material;

the bottom panel is made of a second material that is less rigid than the first material; and the center insert is made of a third material that is different from the first material and the second material.

11. The shipping base of claim 1 wherein:

the bottom frame is made of wood;

the bottom panel is made of corrugated fiberboard; and the center insert is made of a plastic foam material.

* * * * *